313-414 SR

3/6/79 XR 4,143,293

United States Patent [19]

Hosokoshi et al.

[11] 4,143,293

[45] Mar. 6, 1979

[54] IN LINE ELECTRON GUNS FOR COLOR TUBES, EACH HAVING A CONTROL GRID WITH VERTICALLY ELLIPTICAL APERTURE

[75] Inventors: Kakuichiro Hosokoshi, Neyagawa; Hiroto Nakamura, Takatsuki; Takami Okamoto, Mukou, all of Japan

[73] Assignee: Matsushita Electronics Corporation, Osaka, Japan

[21] Appl. No.: 856,085

[22] Filed: Nov. 30, 1977

Related U.S. Application Data

[63] Continuation of Ser. No. 650,620, Jan. 20, 1976, abandoned.

[30] Foreign Application Priority Data

Jan. 24, 1975 [JP] Japan ..... 50-10772
Jan. 31, 1975 [JP] Japan ..... 50-13903

[51] Int. Cl.[2] ..... H01J 29/50; H01J 29/56

[52] U.S. Cl. ..... 313/409; 313/414

[58] Field of Search ..... 313/411, 412, 413, 414, 313/448, 449, 409

[56] References Cited

U.S. PATENT DOCUMENTS

| | | | |
|---|---|---|---|
| 3,771,002 | 11/1973 | Standaart | 313/411 |
| 3,919,583 | 11/1975 | Hasker et al. | 313/448 |
| 3,952,224 | 4/1976 | Evans | 313/453 X |

*Primary Examiner*—Robert Segal
*Attorney, Agent, or Firm*—Burgess, Ryan and Wayne

[57] ABSTRACT

A color television tube assembly in which the aperture of a control grid of each electron gun is made in the form of an ellipse with its major axis in line with the vertical direction, and the lengths of the vertical and horizontal axes of the aperture of action space of an electron lens electrode are selected different from each other, whereby the beam spot at the center of the screen may become in the form of a vertically elongated ellipse while the beam spots at the horizontal and vertical edges of the screen are in the form of a horizontally elongated ellipse.

1 Claim, 12 Drawing Figures

IN LINE ELECTRON GUNS FOR COLOR TUBES, EACH HAVING A CONTROL GRID WITH VERTICALLY ELLIPTICAL APERTURE

This is a continuation, of application Ser. No. 650,620, filed Jan. 20, 1976 now abandoned.

BACKGROUND OF THE INVENTION

The present invention relates to an improvement of a color television tube assembly of the type comprising a color television tube with three in-line electron guns for producing three electron beams in the same horizontal plane, a horizontal deflection yoke mounted on the color television tube for producing the pincushion-like horizontal deflection magnetic field and a vertical deflection yoke mounted on the tube for producing the barrel-like vertical deflection magnetic field.

The so-called self-convergence in-line electron gun type color television tube in which the horizontal deflection magnetic field with the pincushion distortion and the vertical deflection magnetic field with the barrel distortion are produced has an advantage that a dynamic convergence circuit may be eliminated. However, the electron beam from each electron gun is distorted when it passes through the pincushion distorted horizontal deflection magnetic field and the barrel distorted vertical deflection magnetic field so that the beam spot especially at the edge of the screen is distorted in the form of an ellipse. In general, the further the electron beam is away from the axis of the tube, the more strongly the beam is deflected in the horizontal direction. Therefore, the larger the horizontal deflection angle, the more the beam spot at the screen is elongated in the horizontal direction. On the other hand, the closer the electron beam is to the axis of the tube, the more strongly the beam is deflected in the vertical direction. Therefore, the larger the vertical deflection angle, the more the beam spot at the screen is elongated in the horizontal direction. The larger the deflection angle of a color television tube, the greater the beam distortion or aberration becomes especially at the edge of the screen.

SUMMARY OF THE INVENTION

One of the objects of the present invention is therefore to provide a color television tube assembly in which the beam distortion over the whole surface of the screen may be considerably corrected.

Another object of the present invention is to provide a color television tube assembly which produces the beam spot in the form of a vertically elongated ellipse at the center of the screen while producing the beam spots in the form of a horizontally elongated ellipse at the edge of the screen.

A further object of the present invention is to provide a color television tube assembly in which the aperture of a control grid of each electron gun is made in the form of an ellipse with its major axis in line with the vertical direction, and the lengths of the vertical and horizontal axes of the aperture or action space of an electron lens electrode are selected different from each other, whereby the distortion due to the distortion of electric field of the electron beam which has an elliptical cross sectional configuration and passes said aperture and a crossover reaching the screen may be suppressed.

A further object of the present invention is to provide a color television tube assembly in which a pre-focusing lens may converge the electron beam more strongly in the horizontal direction than in the vertical direction so that the beam distortion due to the difference between the diverging angles of the electron beam; that is the distortion or aberration due to the distortion of the electric field may be suppressed.

To the above and other ends, the present invention provides a color television tube assembly of the type comprising a color television tube with three in-line electron guns for producing the three electron beams in the same horizontal plane, a horizontal deflection yoke mounted on said color television tube for producing the pincushion-like horizontal deflection magnetic field, and a vertical deflection yoke mounted on said tube for producing the barrel-like vertical deflection magnetic field, characterized in that the aperture of a control grid of each electron gun is made in the form of an ellipse with its major axis in line with the vertical direction, and the lengths of the horizontal and vertical axes of the aperture or action space of an electron lens electrode are selected different from each other, whereby the beam spot at the center of the screen may be in the form of a vertically elongated ellipse while the beam spot at the horizontal and vertical edges of the screen may be in the form of a horizontally elongated ellipse.

DESCRIPTION OF THE PREFERRED EMBODIMENTS

Figure 1:
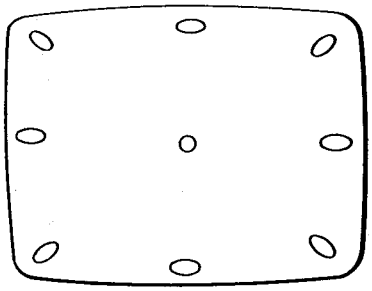
FIG. 1 PRIOR ART
FIG. 1 is a view used for the explanation of the beam spot distortion at the screen of a conventional color television tube.

In the so-called self-convergence type color television tube with three in-line electron guns, the horizontal and vertical deflection systems are so arranged as to produce the magnetic fields with the pincushion and barrel distortions, respectively, in order to eliminate a dynamic convergence circuit. However, the cross section of each electron beam from each of three electron guns passing through the pincushion-like-distorted horizontal deflection magnetic field and the barrel-like-distorted vertical deflection magnetic field are distorted so that the beam spot area at the edge of the screen is distorted in the form of an ellipse as schematically shown in FIG. 1.

Figure 2:
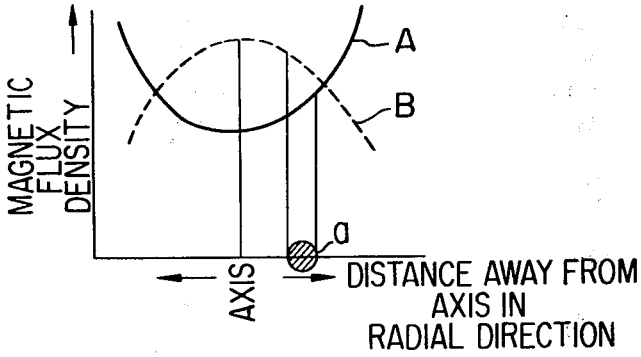
FIG. 2 is a graph used for the explanation of the beam distortion due to the self-convergence magnetic field.

Next referring to FIG. 2, the electron beam aberrations due to the self-convergence fields will be explained. In the pincushion-like horizontal deflection field A, the further the electron beam is away from the axis of the tube, the more strongly it is deflected in the horizontal direction. Therefore, the greater the deflection angle, the more the cross section of the electron beam is elongated in the horizontal direction. On the other hand, in the barrel-like vertical deflection field B, the closer the electron beam is to the axis of the tube, the more strongly the electron beam is deflected in the vertical direction. Therefore, the greater the vertical deflection angle, the more the cross section of the electron beam is decreased in the vertical direction, and is elongated in the horizontal direction. Further, the beam spot area at the corner of the screen is elongated in the diagonal direction of the screen. This beam area distortion or aberration is most remarkable at the edge of the screen of the color television tube with a larger deflection angle.

Figure 3:
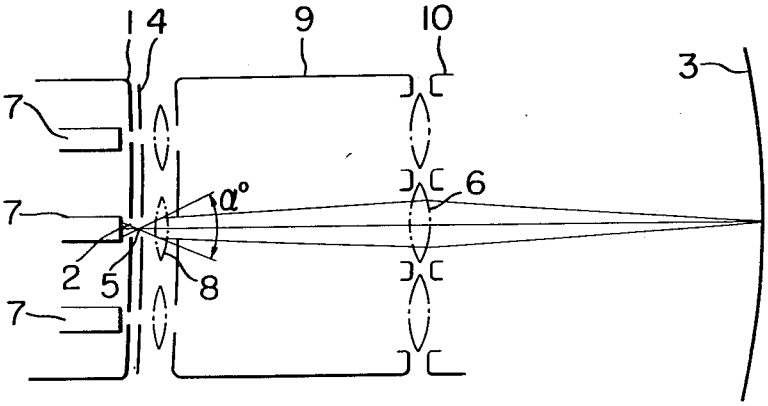
FIG. 3 is a schematic view of the arrangement of in-line type electron guns.

FIG. 3 shows the electron guns arranged in line. When the aperture 2 of a control grid 1 is in the form of an ellipse with its major axis in line with the vertical direction of a screen 3, the electron beam passing through the crossover 5 between the control grid 1 and a shield or second grid 4 has an elliptical cross sectional configuration. The electron beam is diverged after it has passed through the crossover 5. With the elliptical aperture, the horizontal diverging angle $\alpha°$ is greater than the vertical diverging angle. Therefore, the beam distortion in the horizontal direction becomes the greatest in an electron beam focusing lens and especially at a main lens 6. In FIG. 3, reference numeral 7 denotes cathodes arrayed in the horizontal direction; 8, a pre-focusing lens; 9, a first anode or third grid; and 10, a second anode or fourth grid.

Figure 4:
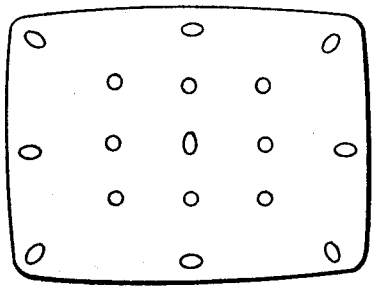
FIG. 4 is a schematic view used for the explanation of the area or shape of the beam spot at the screen of the color television tube in accordance with the present invention.

Next some preferred embodiments of a color television tube in accordance with the present invention will be described. Briefly stated, in accordance with the present invention, the aperture of the control grid is in the form of an ellipse with its major axis in line with the vertical direction so that the beam spot at the screen may become in the form of an ellipse with its major axis in line with the vertical direction when the electron beam is not deflected. The ratio between the major and minor axes is suitably selected so that the true circular beam spots may be produced in the area midway between the center of the screen and its edge as shown schematically in FIG. 4. Even though elliptical beam spots are produced at the center and edge of the screen, the eccentricity of an ellipse is considerably smaller than that of the elliptical beam spots produced on the screen of the conventional color picture tube. Therefore, the beam distortion may be considerably improved as a whole.

FIRST EMBODIMENT, FIGS. 5 AND 6

Figure 5:
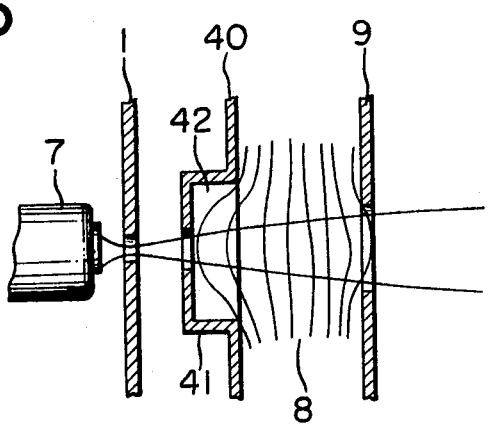
FIG. 5 is a schematic sectional view of a first embodiment of the present invention.
Figure 6:
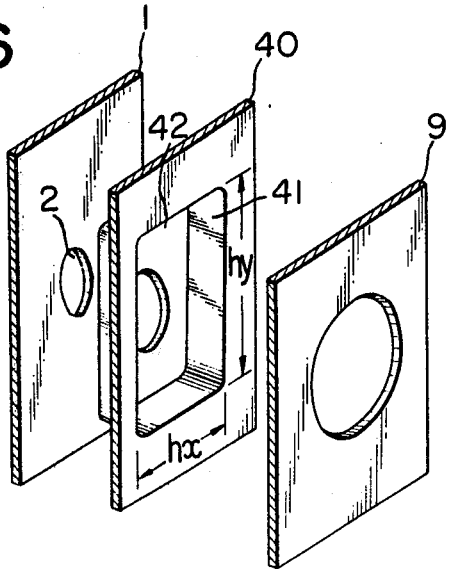
FIG. 6 is a perspective view thereof.

In the first embodiment shown in FIGS. 5 and 6, a shield grid 40 is drawn toward the control grid 1 so as to form a bulged portion 41 having a rectangular or elliptical cross sectional configuration. The horizontal dimension hx and vertical dimension hy of the action space 42 defined by the bulged portion 41 must satisfy the following relation:

$hx < hy$

With the shield grid 40 with the above construction, the pre-focusing lens 8 converges the electron beam more strongly in the horizontal direction than in the vertical direction so that the beam distortion due to the difference between the horizontal and vertical diverging angles; that is, the beam distortion caused by the electric field distortion may be suppressed. However, it should be noted that when the ratio hy/hx is too great, the electric field is more distorted, thus resulting in the further distortion of the electron beam.

SECOND EMBODIMENT, FIGS. 7 AND 8

Figure 7:
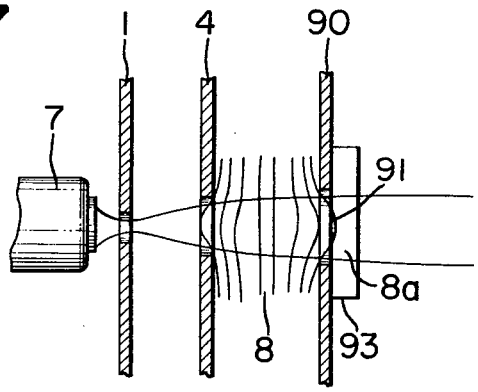
FIG. 7 is a schematic sectional view of a second embodiment of the present invention.
Figure 8:
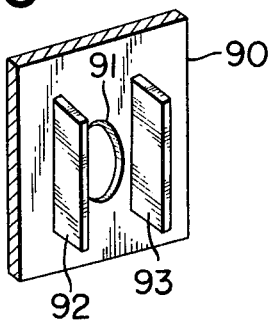
FIG. 8 is a perspective view thereof.
Figure 9:
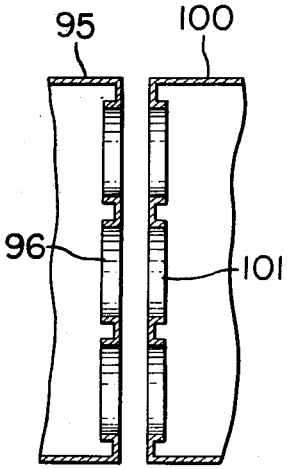
FIG. 9 is a schematic sectional view of a third embodiment of the present invention.
Figure 10:
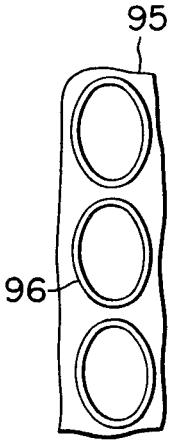
FIG. 10 is a perspective view thereof.

In the second embodiment shown in FIGS. 7 and 8, two tongue-shaped conductors 92 and 93 are extended in parallel with each other from the major surface of the first anode 90 opposite to the major surface facing the shield grid 4, and are spaced apart from the aperture 91 of the first anode 90 by a suitable distance. The tongue-like conductors 92 and 93 define an action space in which the intensity of the diverging electric field 8*a* of the pre-focusing lens 8 may be made weaker in the horizontal direction than in the vertical direction. Therefore, the pre-focusing lens 8 converges the electron beam more strongly in the horizontal direction than in the vertical direction so that the beam distortion due to the distortion of the electric field may be suppressed.

THIRD EMBODIMENT, FIGS. 9 AND 10

The apertures 96 and 101 of a first anode 95 and a second anode 100 are made in the form of an ellipse with its major axis in line with each other and with the vertical direction. Therefore, the main lens 6 converges the beam more strongly in the horizontal direction than in the vertical direction so that the beam distortion due to the distortion of the electric field may be suppressed because of the same reason described above.

FOURTH EMBODIMENT, FIGS. 11 AND 12

Figure 11:
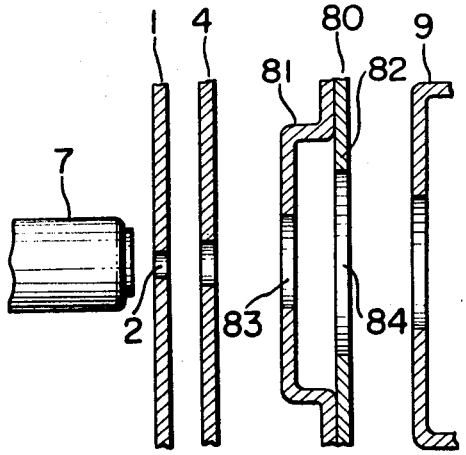
FIG. 11 is a schematic sectional view of a fourth embodiment of the present invention.
Figure 12:
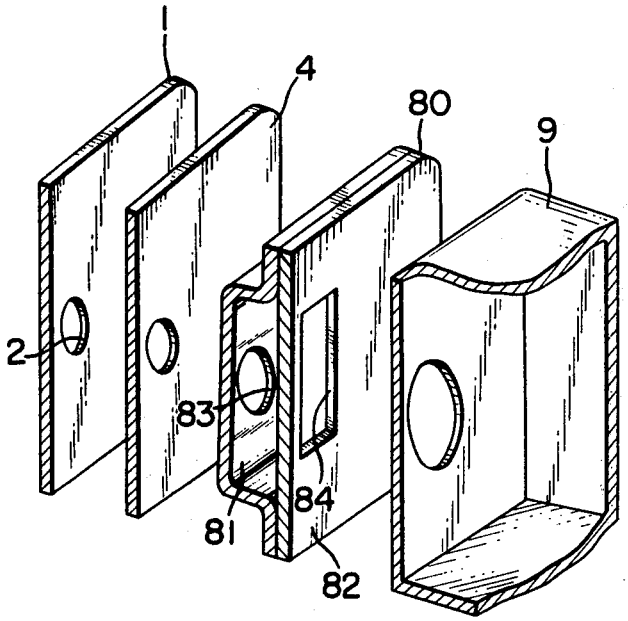
FIG. 12 is a perspective view thereof.

In the fourth embodiment shown in FIGS. 11 and 12, an auxiliary electrode 80 is interposed between the shield grid 4 and the first anode 9 so that the pre-focusing lens 8 may converge the electron beam more strongly in the horizontal direction than in the vertical direction. The auxiliary electrode 80 consists of a bulged electrode 81 with the bulged portion directed toward the shield grid 4 and a flat electrode 82. A circular aperture 83 is formed through the bottom of the bulged portion of the bulged electrode 81, and the horizontal dimension hx and vertical dimension hy of an aperture 84 of the flat electrode 82 satisfy the following relation:

$hx < hy.$

Therefore, as described above, the pre-focusing lens 8 converges the beam more strongly in the horizontal direction than in the vertical direction so that the distortion of the electric field caused by the difference between the diverging angles and the beam distortion due to the distortion of the electric field may be suppressed.

In the fourth embodiment, about 300 to 500 volts may be impressed to the shield grid while about 3,000 to 6,000 volts may be impressed to both the first anode 9 and the auxiliary electrode 80. The voltage impressed to the auxiliary electrode 80 may be raised above or lowered below the voltage impressed to the first anode 9 so that the convergence of the electron beam by the pre-focusing lens in the horizontal or vertical direction may be suitably adjusted. Even when the first anode 9 and the auxiliary electrode 80 are interconnected within or without the tube, the convergence of the beam by the pre-focusing lens in both the horizontal and vertical directions may be suitably adjusted by the suitable adjustment of the distance between the auxiliary electrode 80 and the shield grid 4.

What is claimed is:

1. In a color cathode-ray television tube comprising a screen, three in-line electron guns for generating and directing three corresponding electron beams along paths lying in a common horizontal plane to said screen, each electron gun including (i) a control grid having an elliptical aperture with a vertically oriented major axis for predistorting the corresponding electron beam, (ii) a first apertured electrode and an adjacent second apertured electrode between said control grid and said screen, said electrodes comprising an electron lens, and (iii) magnetic deflection means between said electrodes and said screen, wherein said beams are subjected to vertical and horizontal magnetic deflection fields during operation of said tube for scanning said beams vertically and horizontally over said screen within a deflection zone, and said electron beams tend to become elongated in the horizontal direction as their deflection angle increases away from the center of said screen, the improvement comprising lens distorting means integral with at least one of said first and second electrodes for modifying the characteristics of said electron lens so that said lens converges said corresponding beam more in the horizontal direction than in the vertical direction, to at least partially compensate for said tendency of said beams to become horizontally elongated and to render said beams more nearly circular over a substantial area of said screen, with said beams being of vertically elongated elliptical shape at the center of the screen and of horizontally elongated elliptical shape at the center of each horizontal and vertical edge of the screen, said first electrode being disposed between said control grid and said second electrode, said first electrode having a conductive substantially rectangularly recessed portion, the vertical dimension of said portion being greater than the horizontal dimension thereof, said portion defining an action space, with the bottom wall of said recessed portion being adjacent said control grid, a first hole in said bottom wall through which said electron beam may pass.

* * * * *